United States Patent [19]

Donini

[11] Patent Number: 4,893,104

[45] Date of Patent: Jan. 9, 1990

[54] ELECTROMAGNETIC ACTUATOR DEVICE, IN PARTICULAR FOR THE SELECTION OF THE NEEDLES ON A KNITTING MACHINE

[75] Inventor: Leone Donini, Brescia, Italy

[73] Assignee: Santoni S.r.l., Brescia, Italy

[21] Appl. No.: 290,406

[22] Filed: Dec. 29, 1988

[30] Foreign Application Priority Data

Jan. 11, 1988 [IT] Italy ..... 20415/88[U]

[51] Int. Cl.[4] ..... H01F 7/08

[52] U.S. Cl. ..... 335/266; 335/276; 335/279

[58] Field of Search ..... 335/266, 267, 268, 270, 335/274, 275, 276, 279

[56] References Cited

U.S. PATENT DOCUMENTS 1,832,146 11/1931 Somajni ..... 335/276 X
3,435,395 3/1969 Rosenberg et al. ..... 335/276
3,548,353 12/1970 Bausch ..... 335/276
3,858,135 12/1974 Gray ..... 335/266
4,097,833 6/1978 Myers ..... 335/268 X

*Primary Examiner*—George Harris
*Attorney, Agent, or Firm*—Diller, Ramik & Wight

[57] ABSTRACT

An electromagnetic acutator device for selecting needles in a knitting machine comprises two windings (3,4) positioned on opposite sides relative to an armature (5) in a support structure (2) made from a ferromagnetic material. The armature (5), which is also made from a ferromagnetic material, is hinged onto the structure (2), according to an axis substantially perpendicular to the axis of the windings (3,4) and is subject to the action of the magnetic filed generated by the windings (3,4) in order to be moved between two angular positions. The armature is hinged at one end engages a selection lever (11) at its other end, and has a configuration with two transversal portions (19, 20) protruding from opposite sides, and penetrating inside the interior of the windings (3,4).

12 Claims, 2 Drawing Sheets

ELECTROMAGNETIC ACTUATOR DEVICE, IN PARTICULAR FOR THE SELECTION OF THE NEEDLES ON A KNITTING MACHINE

BACKGROUND OF THE INVENTION

The present invention relates to an electromagnetic actuator device, in particular for the selection of the needles in a knitting machine.

Devices for the selection of the needles in knitting machines are known, which comprise a plurality of needle selection levers positioned superimposed to one another on a plurality of levels, and selectively swinging around respective parallel, horizontal axes between a resting position, in which position an end of the same levers is at an intermediate level between levels of selection butts of needle selection members, and does not interfere with them; and a working position, in which such an end is at the level of a corresponding level of needle butts, and engages the selection butts of said level by pushing the relevant selection members into a non-working track, in which they do not lead the corresponding needles to generate the loop.

The orientation of the selection levers is generally carried out by means of electromagnetic actuators, each of which is associated to a respective selection lever, and is selectively excited according to a pre-established program of needle selection.

The actuators may act on the respective selection levers either directly, or through relevant armatures, the swinging movement of which is transmitted to the levers by means of a geometrical coupling between one end of the armature, and one end of the relevant needle selection rocker lever, e.g., as disclosed in U.K. patent application No. 2.008,157.

These electromagnetic-control selection devices show the advantage that the type of selection can be rapidly modified by simply changing the sequence of the control impulses sent to the various electromagnets by an electronic equipment, which can be programmed from time to time according to the desired sequence.

However, the electromagnetic actuators, which are necessary in a number equal to the number of the selection levers, involve problems of dimensions, because, owing to power reasons, the size of the electromagnets cannot be reduced under certain limits, otherways the action of magnetic attraction will be insufficient for the intended purposes.

The higher and higher speeds of the knitting machines require higher and higher actuation speeds, and, consequently, the moving masses and the frictions to be more and more reduced. The high number of oscillations of the moving members involves continuous impact stresses, and hence a considerable wear of the relevant members, with a loss of precision.

In case a fault occurs to one of the actuators, the operation of replacement of it is mostly complex and difficult, and hence long, with times of inactivity of the selection device, and of the relevant knitting machine, which result in increases in the production costs.

SUMMARY OF THE INVENTION

The present invention aims at providing a solution for the above cited problems, by means of an electromagnetic actuator device which has small overall dimensions, performs an extremely fast and precise action, and is easy to be installed and/or replaced, and is capable of operating for long time periods without incurring wear problems.

Such an electromagnetic actuator device, in particular for the selection of the needles in knitting machines, comprises at least one winding in a support structure made from a ferromagnetic material and a mobile armature, also made from a ferromagnetic material, hinged onto the structure, and subject to the action of the magnetic field generated by said at least one winding in order to be moved between two angular positions, with the armature being engageable with a member to be actuated, such as a selection lever, or the like, characterized in that two windings are provided, positioned on opposite sides relatively to the armature, and that the armature, hinged at one of its ends, which is opposite to the end which is engageable with the member to be actuated, according to an axis substantially perpendicular to the axis of the windings, has a configuration with two transversal portions protruding from opposite sides, and penetrating inside the interior of the windings.

Advantageously, the armature can be given a substantially cross-like shape. The support structure can be formed by two parts connected to each other with possibility of separation, and with each one of said parts being given a configuration suitable for housing a winding, with the plane along which said parts are connected to each other being substantially perpendicular to the axis of the windings.

Such a kind of actuator device has a compact structure, with not very large overall dimensions, capable of generating an efficacious action of attraction of the armature thanks to the portions thereof which penetrate inside the interior of the windings. This configuration makes it possible the overall dimensions to be decreased, and the available room to be advantageously exploited. The configuration of the structure as two parts which are connected to each other with possibility of separation, and wherein each one of them houses one winding, facilities the operations of dismantling and, if necessary, of replacement of the parts. The positioning of two windings on opposite sides relatively to the armature makes it possible a same action to be performed on the armature in both moving directions, and a same stability to be achieved of the position of both armature stroke limits.

Further details of the finding will be better understood from the following disclosure, made by referring to the hereto attached drawings, wherein:

DESCRIPTION OF THE PREFERRED EMBODIMENTS

Figure 1:
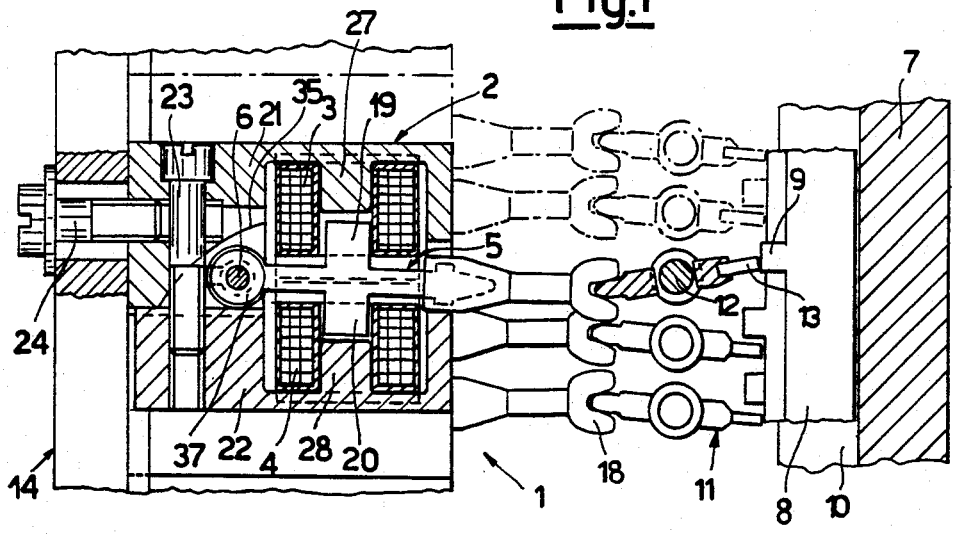
FIG. 1 shows a sectional view according to path II of FIG. 2, through an actuavtor device according to the present invention, which is a part of a needle selection device of a knitting machine of circular type.

Referring to the above figures, an electromagnetic actuator device 1 according to the present invention, in the depicted exemplifying form of practical embodiment, comprises a support structure 2 made from a ferromagnetic material, in which two windings 3, 4 are provided, and an armature 5 is provided as well, which is made from a ferromagnetic material, is hinged onto the support structure 2 at 6, according to an axis substantially perpendicular to the axis of the windings 3, 4, and is so positioned, as to be subject to the action of the magnetic field generated by either one of both windings 3, 4, in order to swing to the one, or to the other one, of two angular positions defined by suitable stop surfaces.

Taking into consideration the particular case of an actuator device 1 applied to a knitting machine with a needle cylinder 7 and needle selection members 8, e.g., needle selectors with butts 9 positioned inside the grooves 10 provided on the cylinder 7, each actuator 1 with its relevant armature 5 is associated, in a known way, to a selection lever 11, hinged according to a horizontal axis 12, and capable of assuming two angular positions as a consequence of its engagement with the relevant armature 5. Each lever 11 is provided with a relevant engagement portion 13 in order to engage the butts 9 when the lever 11 is in its operating position, in which the engagement portion 13 is at the same level as of the butts 9 of a certain level (i.e., such a position as shown for the middle lever 11 of FIG. 1), and pushes the selection members 8, in a known way, towards the bottom of the relevant grooves 10, so that they do not bring the relevant needles to their working position. When, on the contrary, the lever 11 is moved into its non-operating position, its engagement portion 13 comes to be at an intermediate level between two adjacent levels of butts 9, and does not come into engagement with any butts (i.e., such a position as shown for the other levers 11 of FIG. 1), so that the relevant needle selectors 8 bring the corresponding needles to form the loop, in a per se known way.

Figure 2:
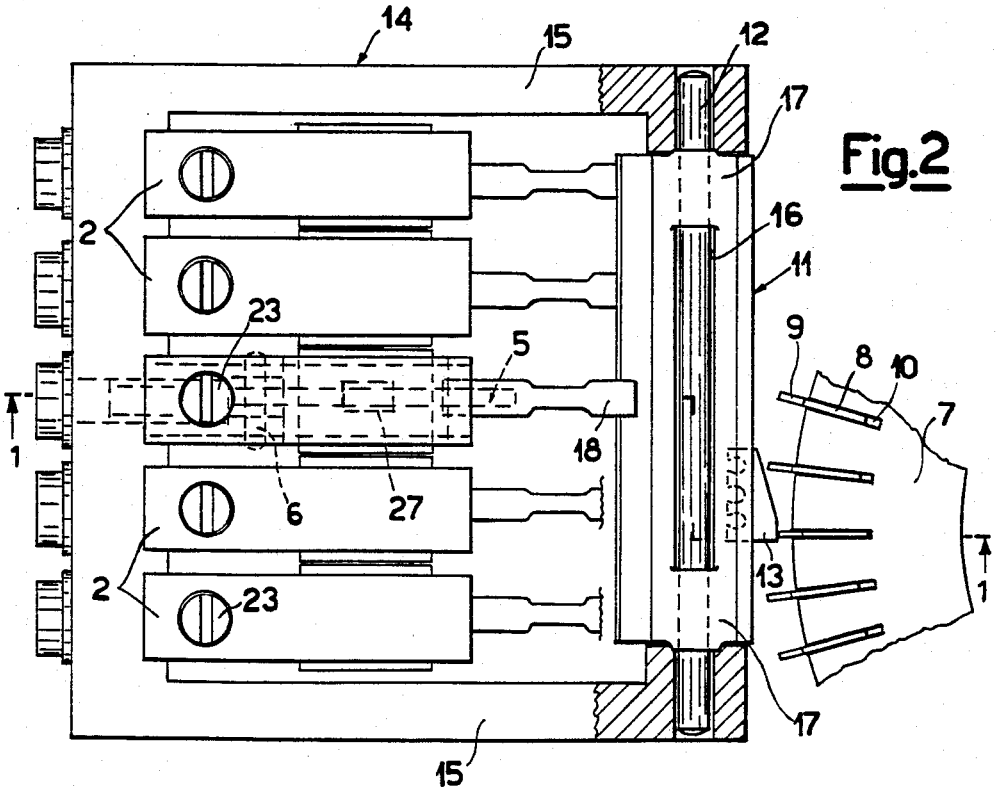
FIG. 2 is a partially sectional, top view of the selection device, wherein a plurality of such actuator devices are shown.

The selection levers 11, positioned superimposed to one another, in a number equal to the levels of butts 9, as well as the relevant actuators 1 are borne by a support 14 fastened to the stationary portion of the knitting machine. The levers 11, hinged onto side shoulders 15 of the support 14, are advantageously extended in the direction of the hinging axis 12, so as to make it possible the various actuators 1 to be installed in a staggered arrangement, owing to reasons of overall dimensions, with the various levers 11 being kept equal to one another, as shown in FIGS. 1 and 2.

In the exemplifying form of practical embodiment herein depicted for exemplifying purposes, the levers 11 have an open central portion 16, and two end portions 17, which definine the seats for the hinging pivot 12. In any case, for the purposes of the present finding, the shape of the levers 11 is not essential.

Each lever 11 is engaged, at its end opposite to the working end provided with the engagement portion 13, by a substantially fork-shaped end 18 of the armature 5 of the relevant actuator 1. Advantageously, the surfaces of mutual engagement of the lever 11 and of the armature 5 are given the shape on an involute, i.e., as of the cooperating surfaces of two teeth of two cylindrical, straight-tooth gear wheels, so as to ensure the absence of any slippings during their relative movement. In this connection, it is also possible to use properly selected materials for the parts under mutual contact; in particular the fork-shaped end 18 of the armature 5 could be a part made from a wear-resistant, self-lubricating plastic material moulded on the body of the armature 5, as shown, and the lever could be made from a light metal alloy, or from a very rigid plastic material, in particular of fiberglass-reinforced, carbon-fibre-reinforced polyamide material. In this way, with the involute-shaped outline, and the wear-resistant material used, a long useful life, as well as a high operating precision is ensured over time.

Each actuator 1 has its two windings 3 and 4 positioned on opposite sides relatively to the armature 5 and this latter, which is hinged at the end opposite to the end engageable with the selection lever 11—or with any other members to be actuated—is given a long shape, with two transversal portions 19 and 20, protruding from opposite sides, and penetrating the interior of both windings 3, 4. In particular, the two portions 19 and 20 can be aligned to each other, so that the armature comes to have a substantially cross-shaped configuration, as shown in the figures, with the windings 3, 4 being coaxial to each other. The armature 5 is advantageously made from iron with a low coercive power.

The support structure 2 is formed by two parts 21 and 22, which can be connected to each other with the possibility of being separated, with each one of them housing a respective winding 3, 4. Both parts 21 and 22 are provided with one or more juncture planes positioned substantially perpendicularly to the axes of the windings 3, 4, and are fastened to each other by means of a screw 23. In order to fasten the whole structure to the support 14, a screw 24 is provided, which is screwed down inside a screw-threaded bore provided in the part 21. In this way, the assemblage of the actuators 1, as well as the possible replacement thereof, is facilitated. Both parts 21 and 22 can be made from low-coercive-power iron.

Figure 3:
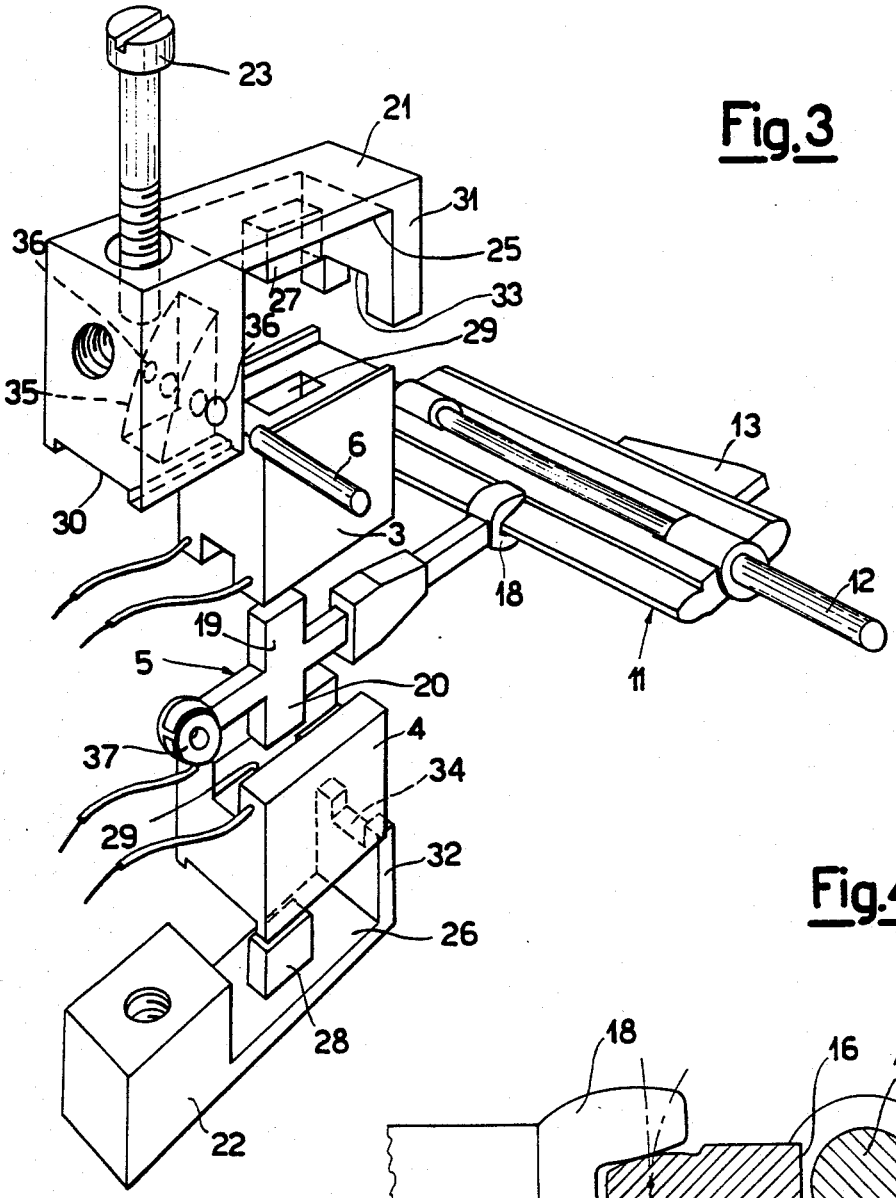
FIG. 3 shows an exploded perspective view of an actuator according to the present invention, operating on a needle selection lever of the selection device.
Figure 4:
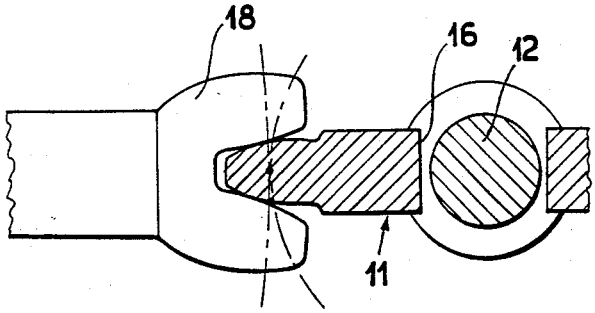
FIG. 4 shows a detail, on a larger scale, of the mutually engaged ends of the armature and of the selection lever.

As it results in particular from FIG. 3, each part 21, 22 is provided with a seat 25, 26, of a generally parallelepipedon-shaped configuration, with a central protruding portion 27, 28; said protruding portions extend towards each other in the direction of the transversal portions 19, 20 of the armature, and define the cores of the windings 3, 4. The same windings have the shape of substantially parallelepipedon blocks, which can be installed inside the seats 25, 26, inside which they are retained by the geometrical engagement of the protruding portions 27, 28 inside the central opening 29 of the windings 3, 4. A hollow 30 provided in the part 21 acts as the female element in order to align the underlying part 22, the thickness of which is slightly smaller than of the part 21.

At the side from which the armature 5 comes out, both parts 21 and 22 of the support structure 2 are provided with respective appendices 31, 32, opposite to each other, and each defining a central opening 33, 34, in order to allow the swinging movement of the armature 5 to take place. These appendices, positioned adjacent to the respective windings 3, 4, are a part of the magnetic loop, and ensure, with a minimum air gap, a particularly high magnetic flux in the magnetic loop, with an efficacious action of the armature 5, also thanks to the penetration of said portions 19, 20 inside the interior of the windings 3, 4.

The armature 5 is hinged onto the part 21, which is provided with a seat 35 for the relevant end of the armature 5, and bores 36 in order to house the pivot 6. Advantageously, on the end of the armature 5, a sleeve 37 of a wear-resistant, self-lubricating plastic material can be moulded, in order to reduce the friction, and increase the useful life of the concerned surfaces.

At it results from the drawings, the overall dimensions of the actuator 1 are very small, thanks to the efficacious exploitment of the spaces.

Advantageously, the transversal portions 19 and 20 can have a distance from the pivot 6, which is shorter than the distance thereof from the operating end of the armature, on which the fork-shaped, needle-selection-lever engaging end portion 18 is provided. This same end portion, anyway constituted by an amagnetic material, may constitute a stroke-limit, positive-stop element for the armature 5, coming to rest against the respective parts of the seats 33, 34 of the appendices 31, 32 of the structure 2, also securing, in this way, a long useful life of the various elements.

One will understand from the above disclosure that an actuator according to the present finding combines a structure having small overall dimensions, easy to be assembled and to be installed, with a fast and reliable intervention action, and with a long useful life.

I claim:

1. Electromagnetic actuator device, in particular for the selection of the needles in knitting machines, comprising at least two windings in a support structure made from a ferromagnetic material, an armature made from a ferromagnetic material hinged relative to said support structure, said armature being subject to the action of the magnetic field generated by said two windings in order to be moved between two angular positions, said armature having a first end for engaging a member to be actuated thereby, charaterized in that said two windings are positioned on opposite sides of the armature, said armature being hinged at a second of its ends opposite said first end, said armature having a hinge axis sustantially perpendicular to the axis of said windings, and said armature having transverse portions projecting from opposite sides thereof to positions between windings.

2. Device according to claim 1 wherein said armature has a substantially cross-like shape.

3. Device according to claim 1 wherein said support structure is formed by two parts connected to each other, each of said parts having means for housing a winding and a plane along which said two parts are connected to each other being substantially perpendicular to the axis of the windings.

4. Device according to claim 1 wherein the support structure includes an end provided with two appendices opposite to each other, said two appendices defining a central opening for the hinging movement of the armature, and said appendices being positioned adjacent to the windings and being a part of the magnetic loop.

5. Device according to claim 1 wherein said windings are blocks having a substantially parallelepiped shape, said blocks are positioned inside respective seats of substantially parallelepiped shape of said support structure provided with central mutually opposing protruding portions opposing one each of said two armature portions and defining therewith cores of the windings.

6. Device according to claim 3 wherein one of said support structure parts is provided with a seat for the hinged second end of said armature, and said armature second end is hinged relative to a pivot housed by said seat.

7. Device according to claim 5 wherein said two mutually opposing portions are positioned a distance from said hinge pivot which is shorter than their distance from said armature first end.

8. Device according to claim 4 wherein the armature first end has a coating of an amagnetic, wear-resistant material thereon defining a stop element for the armature which limits the stroke thereof against respective portions of said appendices.

9. Device according to claim 1 wherein the armature second end is hinged by a pivot, and a sleeve of amagnetic, wear-resistant material is positioned between said pivot and armature second end.

10. Device according to claim 1 wherein said two windings are coaxial to each other.

11. Device according to claim 1 wherein said armature first end and the member actuated thereby have respective involute-shaped engagement surfaces.

12. Device according to claim 4 wherein the armature first end has a coating of an amagnetic, wear-resistant material therein defining a stop element for the armature which limits the stroke thereof against respective portions of said appendices.

* * * * *